US008656670B2

(12) United States Patent
Mouzannar

(10) Patent No.: US 8,656,670 B2
(45) Date of Patent: Feb. 25, 2014

(54) FACILITIES FOR HYBRID TISSUE BANKS

(75) Inventor: Raymond Mouzannar, Houston, TX (US)

(73) Assignee: Stem Cell Reserve, LP, Houston, TX (US)

( * ) Notice: Subject to any disclaimer, the term of this patent is extended or adjusted under 35 U.S.C. 154(b) by 0 days.

(21) Appl. No.: 13/555,187

(22) Filed: Jul. 22, 2012

(65) Prior Publication Data

US 2013/0025221 A1 Jan. 31, 2013

Related U.S. Application Data

(60) Provisional application No. 61/511,277, filed on Jul. 25, 2011.

(51) Int. Cl.

| | |
|---|---|
| ***E04H 1/00*** | (2006.01) |
| ***E04H 3/04*** | (2006.01) |
| ***E04H 6/42*** | (2006.01) |
| ***B01L 1/04*** | (2006.01) |

(52) U.S. Cl.
USPC ..... 52/234; 52/33; 52/174; 454/187

(58) Field of Classification Search
USPC ..... 52/234, 33, 174; 454/187
See application file for complete search history.

(56) References Cited

U.S. PATENT DOCUMENTS

| | | | | |
|---|---|---|---|---|
| 3,470,871 | A * | 10/1969 | Shoen | 600/301 |
| 3,696,805 | A * | 10/1972 | Sweeten et al. | 600/301 |
| 7,083,515 | B2 * | 8/2006 | Rapisarda et al. | 454/187 |
| 7,985,382 | B1 * | 7/2011 | Henry et al. | 422/291 |
| 2002/0108334 | A1 * | 8/2002 | Rapisarda et al. | 52/302.1 |
| 2008/0221919 | A1 * | 9/2008 | Cates | 705/2 |
| 2008/0313973 | A1 * | 12/2008 | Butler Rolf | 52/79.1 |
| 2011/0053486 | A1 * | 3/2011 | Holtz et al. | 454/187 |
| 2013/0025221 | A1 * | 1/2013 | Mouzannar | 52/234 |

* cited by examiner

*Primary Examiner* — Andrew Triggs
(74) *Attorney, Agent, or Firm* — Boulware & Valoir

(57) ABSTRACT

A system, workflow and facilities for hybrid tissue banks are provided with a central access way having spaces on both sides for public and private diagnostic areas, public and private clean room areas for processing, culturing and other manufacturing steps, public and private storage areas, wherein air flow is into said clean rooms and out of said diagnostic areas and said storage areas, and wherein all public facilities are on one side of the central access-way and private facilities are on the other side, and wherein there are sample pass-throughs between each area, and at least the sample pass-through into and out of the clean room processing areas comprise small enclosed chambers having two access panels (one leading to each space), wherein only one panel can open at a time. Preferably, these areas are preceded by receiving spaces and terminated by shipping spaces, which also have pass-through chambers.

24 Claims, 5 Drawing Sheets

FACILITIES FOR HYBRID TISSUE BANKS

PRIOR RELATED APPLICATIONS

This application claims priority to 61/511,277, filed Jul. 25, 2011, and incorporated by reference in its entirety herein for all purposes.

FEDERALLY SPONSORED RESEARCH STATEMENT

Not applicable.

FIELD OF THE INVENTION

The invention relates to design of facilities for hybrid tissue banks—that is banks with facilities for public as well as private use. The facilities include separate spaces to efficiently receive, diagnose, process or manufacture human materials, store such materials, and then release human tissues, cells and fluids for therapy and research. More specifically, the design is intended to create an efficient and monitored workflow in order to produce a human tissue, fluid or cell that is optimized for therapy or research, as well as minimizes the possibility of contamination, either from individuals, the outside, or between the two halves of the facility.

BACKGROUND OF THE INVENTION

Cell therapy is the introduction of cells in an organism to generate, replace or repair injured, missing, degenerated, scarred or diseased tissues and shows tremendous potential in treating human disease, degeneration and injuries. Cell therapy has expanded drastically in the last few years, mainly because of the recent surge in stem cell research, one important source of which has been cord blood. In fact, clinicaltrials.gov shows more than about 1500 completed clinical trials employing stem cells, and another 1500 trials that are actively recruiting patients. Thus, tissue banks that collect and process tissues, cells and fluids for these uses are of growing importance to realize the potential of this promising new therapy.

Currently there are two types of banks for storing human material. Private banks are available for paying customers to store their own material, e.g., cord blood, semen, or blood products, for later private use. Public banks, in contrast, collect and store human material for research and development and for public health uses. To our knowledge, there are few, if any, combination facilities of this kind, e.g., hybrid banks with both public and private, clean room tissue, fluid or cell processing facilities, but we believe that such a structure provides increased efficiencies and economies of scale, as well as providing material for both kinds of users.

However promising the potential of cell therapies, especially stem cell therapies, the results to date have not been as good as anticipated. We believe this is attributable in large part to bad workflow and suboptimal bioprocessing and cell manufacturing at the various banks where such human materials are collected, processed and stored. Cells as therapeutic products are the essence of the bioprocess through which they are manufactured, and sloppy procedures, insufficient sample size, variable storage conditions, and the like can only hurt therapeutic outcomes.

There are many problems in the field that make the manufacturing of these cells suboptimal in their therapeutic potential. Manufacturers of cells can be defined as either of the following: 1. a private or family manufacturer (autologous product manufacturer) that collects, processes and stores stem cells taken from, e.g., a baby's umbilical cord for the purpose of use by the same baby or a first or second degree relative to the baby. 2. A public manufacturer (allogeneic product manufacturer) that collects, processes and stores stem cells taken from a baby's umbilical cord, among other materials, for the purpose of therapeutic use by any public individual that is compatible or matches immunologically with such cells.

Regulation governing these two manufacturers differs in stringency of testing and the environment in which these products are made. In general, there is more leniency on the autologous product manufacturer than the allogeneic product manufacturer. For example, eligibility determination and compatibility tests are not required for an autologous product. Clean room manufacturing is not required for either type of manufacturer, and the efficacy tests required for both manufacturing types are suboptimal.

Working in an unclassified room increases the chances of contaminating the cellular product. A random or complicated workflow is also doomed to increase the risk of mislabeling, reduce the safety of the operation, and erodes the controls. An air quality with low particle count or what is known as a classified clean room reduces the chances of air borne agents like viruses and bacteria and other particulates damaging the product or contaminating tools that touch the product.

Thus, what is needed in the art, is a much more rigorous production of human material for therapeutic uses, and the facilities needed to optimize the production of such materials.

SUMMARY OF THE INVENTION

This invention reconciles the differences between autologous and allogeneic processing, and solves problems of efficiency and quality controls by defining manufacturing process having controlled air, temperature, power, safety, and clean room processing environment for receiving, diagnosing, processing, storage and shipment of human materials for therapy or research.

The invention in one embodiment is a cell processing and manufacturing facility architecture or floor plan that is designed to reduce the risk of material loss, mislabeling and mishandling of human samples and their derivatives. The duplication of the operating area, the unidirectional work- and air-flow, temperature and equipment controls and monitoring, back-up power and monitoring, liquid nitrogen supply and monitoring, all of which constitute an integrated system, serves to increase the efficiency of the manufacturing and reduces errors from receiving to release. Furthermore, the use of clean room facilities for actual sample processing is above and beyond what is required under current regulations, but should serve to significantly improve quality and reduce poor outcomes, as well as provide significant patient reassurance.

Generally speaking, the facilities for a hybrid bank are duplicated on either side of a central access-way or corridor, having roughly mirrored spaces for necessary diagnostics, a clean room entry point and clean room processing/manufacturing facilities, a storage space, and optionally, separate receiving and shipping spaces.

Air aspirated from outside is processed before it is pressure blown into the clean processing room space, bifurcates and flows out of the remaining spaces. In this way, positive airflow is maintained, and the chance of contamination minimized and controlled. Ideally, there will be sample pass-through facilities, for example a small chamber with doors on either side for the transfer of sample to the next space, without incurring human traffic flow for same, and without allowing back flow of air.

All equipment, airflow, temperatures, etc. are monitored in a nearby control room, and reports sent to essential personnel, e.g., by smart phone, in the event that, e.g., a refrigerator malfunctions.

In some embodiments, it may be preferred to only include one half of the floor plan, where the bank will be for either private or public uses, but not both.

Workflow in the facility is improved because the complete process is in-house and continuous, is more likely to proceed flawlessly and is easier to troubleshoot, as every step and piece of equipment is monitored. Contamination is minimized by minimizing traffic and by including clean room space and outward airflow. The chance of cross-contaminating private and public samples is likewise minimized, since the facilities are secured and completely separated. The duplication of all equipment and facilities also provides for emergency equipment in the event of failure of one or more devices.

The current invention takes into consideration manufacturing problems in the prior art and improves the process of collecting, diagnosing, processing, manufacturing, storing and release of cellular products for therapy or research by introducing a constantly monitored facility that comprises six to ten (or more) critical rooms where half (3-5 rooms or more) is distributed on one side, the other half roughly mirror imaging the other and the halves separated by a controlled access hallway and doors. Alternatively, the halves can be directly juxtaposed with controlled access doorways therebetween for emergency access. However, the central hallway is preferred as it allows for staff to access their own workspace without travelling through each sequential workspace.

The facility floor plan starts with a diagnostic and research area on each side, followed by a clean room processing and manufacturing area on each side (along with entryway facilities for gowning), to a storage area on each side. Preferably, this floor plan is preceded by a sample receiving area, as well as terminated with a sample shipping area. As discussed above, airflow is into the clean room area, and out of the diagnostic and storage areas (and if present the receiving and shipping areas), and all equipment is continuously monitored. Samples travel from one area to the next with pass-through windows, which preferably comprise small chambers with two doors, and preferably only one door can be opened at once.

The above can be combined with client reception, control rooms, nitrogen tank rooms, generator rooms, offices, and the like, as needed and as space permits. However, these additional spaces are exterior to the basic plan described above so that the flow of sample is never interrupted. Such offices etc. are not part of work flow (defined with respect to tissue processing) and thus do not interrupt the basic floor plan, but are appended on one or more edges. Each of the work spaces described herein can be subdivided as well, if this is beneficial to work flow or the housing of equipment.

The central hallway area is restricted to trained personnel, or when needed emergency/repair personnel escorted by trained personnel. The hallway commences by a secured door at the level of the receiving area. From here, trained personnel can enter receiving areas on either side through other secured doors. Trained personnel can continue down the hallway and enter the diagnostics and research areas through more secured doors on either side of the hallway. Further down the hall is a secured door access to an air locked gowning area where trained personnel dress up in special garments and may wash hands and face before a secured door entrance into the processing and manufacturing rooms on either side of the hallway.

If desired, the clean room area can instead begin at the diagnostic space (e.g., one space earlier), and diagnostics entered via airlock but this may not be necessary since except for sampling for the diagnostic tests, sample processing really commences in the processing area and this is the most important area to keep aseptic. Alternatively, diagnostics and processing could be combined into a single space.

Each processing room is air quality and flow controlled by special filters and vents that blow highly filtered very low particulate air into the processing rooms. This is the only air that enters the processing rooms as it creates a positive pressure in the room so that when the clean room processing door is opened, air flows out rather than in. Air also leaves the processing rooms by positive pressure through vents into adjacent diagnostic and storage areas.

From the gowning area, trained personnel can continue walking down the hall to reach a secured e.g., by an iris or fingerprint or card reader, door that leads to the hall separating the two opposite storage areas. Storage areas on either side of the hall are accessed through secured e.g., voice or message activated, doors as well. Further down are other secured doors on either side of the hall leading to release rooms where cells removed from storage and placed in shipping containers are prepared to ship to transplantation centers. Alternatively, cells removed from storage can be placed immediately in a shipping container and taken back through the hall to the receiving area where they are prepared to ship to transplantation centers. However, since this reverses sample flow it is less preferred.

Whether a release room exists or not, a door at the end of the hall will lead either outside the building or another hallway that returns to the receiving area from behind storage, processing, diagnostic areas. In case there is a return hallway, an exit secured door is placed at the end of the building that leads to the liquid nitrogen supply tanks and the back-up generator securely fenced areas. Doors of course can be varied, based on local building codes as well as on facility needs.

Airflow is unidirectional, aspirated from outside through special ventilators, into filters, to processing rooms, to diagnostic and storage rooms and back to hallways and receiving areas before leaving the building. Therefore, clean air that flows into the processing rooms never returns. The rest of the rooms are receiving processing room air output that is cleaner that normal unfiltered air and hence minimizing air borne contaminants and risk of losing the effectiveness and purity of the biological material. In some embodiments, the clean room facilities can be further extended to the storage and diagnostic areas as well. However, we do not anticipate that this is required given the airflow patterns described herein.

To reduce personnel circulation and therefore minimize air turbulence and risk of errors, material can be passed through special airtight double door pass-through chambers. Pass-through chambers are between diagnostic and processing rooms, between processing rooms and storage rooms and between storage and release rooms, if the latter exists. These chambers can include a UV lamp that can be switched on when nothing is passing through and off when the door is accessed. Windows between receiving and shipping rooms can be either single panel windows, or the double panel chambers described above.

Stored material that needs to be released will be removed from liquid nitrogen Dewars in the storage room and placed in a portable liquid nitrogen Dewar before shipping. Shipping can be initiated from a release room adjacent to the storage room or from the receiving area, as space permits.

The facility is made so that doors and equipment are monitored 24 hours a day 7 days a week. Probes that control equipment power, temperature, airflow, all windows and doors, and the like, perform the monitoring. Probes are wired to units found in an information technology (or IT) or mechanical room or, if space permits, a control box in the access hallway. The monitoring system sends signals to personnel immediately on detection of a deviation from set parameters. Hence, personnel are immediately alerted that a problem exists.

If the problem is not immediately reparable, critical biological and other material can be transferred from the defective equipment or room to its duplicate on the opposite side of the hallway, but this is intended for emergency use only. To minimize the possibility of confusion between samples in such emergency use, all public and private samples and equipment should be differently color coded, e.g., in red or green. Similarly, when power is out, battery systems and a back up generator immediately kick in to maintain and restore normal power without losing constant monitoring and operation.

The facility is designed so that liquid nitrogen is supplied from tanks placed outside the building or at least outside of these main facility rooms. These tanks constantly supply e.g., 6 large liquid nitrogen Dewars in each storage room with liquid nitrogen. Tanks are constantly monitored for liquid nitrogen reserve. Reserve should always be kept at a level where it lasts at least two weeks in conditions where outside temperature is above 95 degrees Fahrenheit.

The facility 40 can be designed, as shown in FIG. 3, so that the roof 42 is covered by another reflecting canopy 41 at least 5 feet higher than the roof 42 and which is made of sun reflecting material and does not retain heat underneath to protect the roof 42 from direct heat, falling objects, including snow, rain and leaves that may clog exhausts and conduits.

Preferably, the entire facility or at least the dual processing areas are manufactured as a unit, or modular components of a complete unit, and shipped intact to a site for installation. In this way, a standard floor plan can be easily implemented, and cost efficiencies thereby realized.

BRIEF DESCRIPTION OF THE DRAWINGS

FIGS. 2A and 2B are schematic views of another exemplary floor plan for a hybrid tissue bank, wherein FIG. 2A is further divided into FIGS. 2A-1 and 2A-2 for clarity.

DESCRIPTION OF EMBODIMENTS OF THE INVENTION

The invention provides a novel system, facility workflow and floor plan for the collection, processing, storage and use of human materials.

By "mirror imaging" we do not mean to imply that the spaces are identical, as variation in shape and placement of equipment is allowable. Instead we mean to imply a rough mirror image of areas or rooms along the central corridor, not slavish duplication of details.

By "diagnostic" area or space, what is meant is a room or space for assessing biological contamination of samples, viral infections, tissue typing and other preliminary processing procedures.

By "clean room", what is meant is an enclosed room that is controlled with respect to air quality, particulates, air flow and access, such that the room is suitable for clean manufacturing procedures. The clean room can be built on site according to known designs and commercially available equipment, or can be a prefabricated, modular clean room.

By "processing" area or space, what is meant is a place dedicated to processing of human materials to make products suitable for human or research use, including washing, disruption or comminution of tissues, cell selection techniques, cell culturing or other amplification techniques, preservation techniques, and the like.

By "storage" area what is meant is an area for storage of human tissues including fridges, freezers, nitrogen Dewars, and the like.

By "shipping" and "receiving" areas what is meant are those space dedicated to either receiving or shipping samples, labeling, packaging, and the like.

By "pass-through" windows or chambers, what is meant are small opening with an access panel, window, or door, through which a sample can be passed to the next area, but which is too small for human traffic.

By "pass-through chamber," what is meant is a small chamber, with two access panels, windows, or doors, to the space on either side of the chamber, wherein preferably only a single panel can be opened at one time. Preferably, the pass-through chamber has UV light or other decontamination means that activates whenever both doors are closed.

This system, work flow and floor plan was specially designed for hybrid public and private blood and tissue banks for the processing and storage of umbilical cords, but it can advantageously used for any human bank, including for cadavers, blood, other types of stem cells, semen, and the like.

The following examples are illustrative only, and are not intended to unduly limit the scope of the invention.

Example 1

Figure 1:
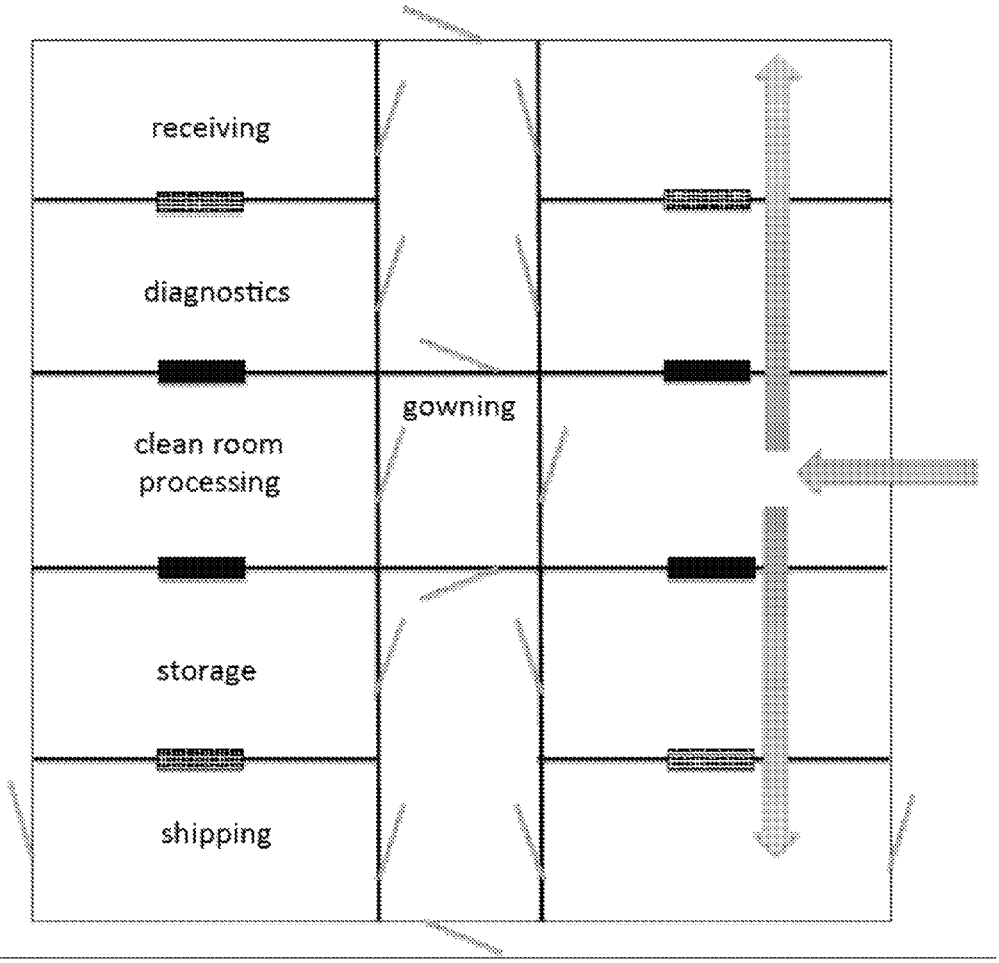
FIG. 1 is a schematic of an exemplary floor plan for a hybrid tissue bank.

FIG. 1 shows an exemplary floor plan, having a central corridor with mirror image public and private spaces on each side. The spaces comprise optional receiving room, followed by a diagnostic room, followed by a processing and/or manufacturing clean room spaces, followed by a storage room, followed by an optional shipping room. Any of these rooms can be partially or completely subdivided, as needed for processing or architectural considerations, but these are the minimum spaces needed for clean economical workflow. Although less desirable, the shipping rooms can be combined with the adjacent spaces. However, separate shipping rooms are preferred where space permits.

Although doors are drawn on this figure (grey diagonal lines), the placement of doors is optional and even where doors are present, access can be controlled from one or both sides, and certain doors can be designated for emergency use only. Doors are preferably of the sliding left or right type, and in the event they are swinging doors, they should preferably open to the outside of the room (e.g., corridor).

Pass-through chambers are indicated by black boxes between spaces, and pass through windows are indicated by the hatched boxes, but if desired the pass-through windows can be pass-through chambers as well.

Entry to the clean room is via the airlock and gowning space only. Airflow (shown by wide grey arrows) is into the clean room, and then the airflow bifurcates and flows out through the other spaces. Thus, contamination is minimized.

A cleanroom is a room in which the concentration of airborne particles is controlled to specified limits. Typical office building air contains from 500,000 to 1,000,000 particles (0.5 microns or larger) per cubic foot of air. A Class 100 cleanroom is designed to never allow more than 100 particles (0.5 microns or larger) per cubic foot of air. Class 1000 and Class 10,000 cleanrooms are designed to limit particles to 1000 and 10,000 respectively.

Contaminants are generated by people, process, facilities and equipment, and must be continually removed from the air. The only way to control contamination is to control the total environment. Airflow rates and direction, pressurization, temperature, humidity and specialized filtration all need to be tightly controlled, and the sources of these particles need to controlled or eliminated whenever possible.

The clean room is preferably a FDA-approved, cGMP Class 10,000 cell processing facility clean room facility. Preferably the clean room is double-walled, and the air for the GMP facility is supplied by a dedicated HVAC system, which draws air into the clean room using 10 HEPA filters (modified as needed for the size of the space); these filters remove particles greater than 0.3 μm to prevent contamination of the facility.

Preferably, the clean room (and ideally all spaces) are constructed using smooth, monolithic, cleanable, chip resistant materials with a minimum of joints and seams and no crevices. Vinyl or Epoxy floor system features seal seams to prevent accumulative contamination. Use of a seamless ceiling works to ensure servicing and installation of terminal HEPA or supply diffuser with proper sealants works to minimize leakages.

Construction using various clean room modular construction materials are preferred as easy to assemble and having been designed and manufactured with clean room specifications in mind. Thus, glass wall panels or glass and fiberglass wall panels may be preferred as easy to assemble and easy to clean.

The clean room facility is made of three zones, the actual clean room where processing occurs (preferably class 10,000), as well as a gowning room (preferably class 10,000), and an entry airlock room (preferably class 10,000 or 50,000 or more) (not detailed in FIG. 1). By class 10,000 compliant, what is meant that the facility at least complies with the US FED STD 209E regulations or equivalent ISO 14644-1 cleanroom standards, or the equivalent standards from another country.

The airlock contains electronically controlled, interlocking doors to prevent more than one door from opening at a time. Positive pressure is maintained in the clean room to prevent airflow into the clean room facility. The hoods in the facility are preferably class 100 biohazard hoods that maintain laminar flow to further prevent contamination of cellular and tissue specimens.

Example 2

Figures 1, 2A:
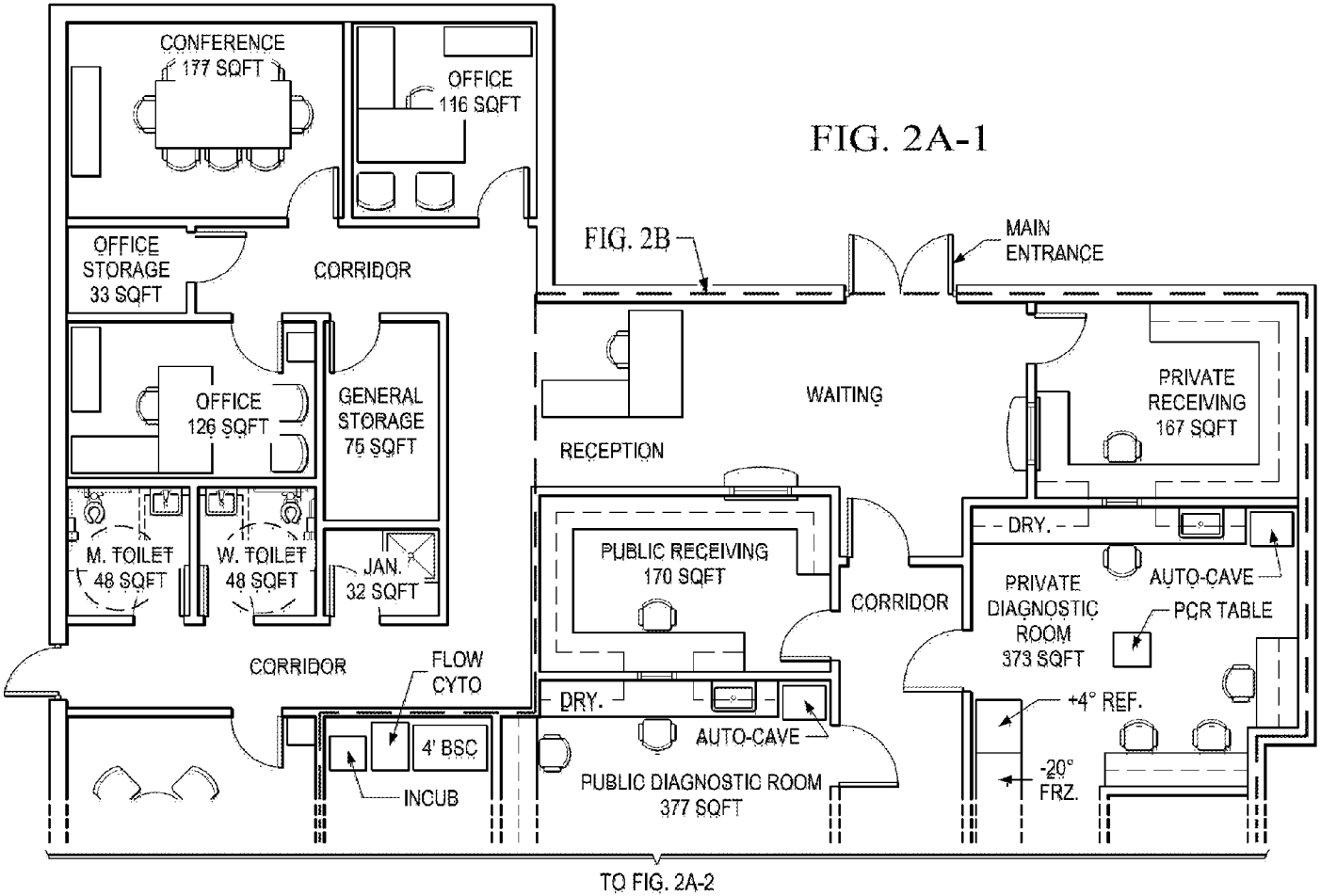
Figures 2, 2A:
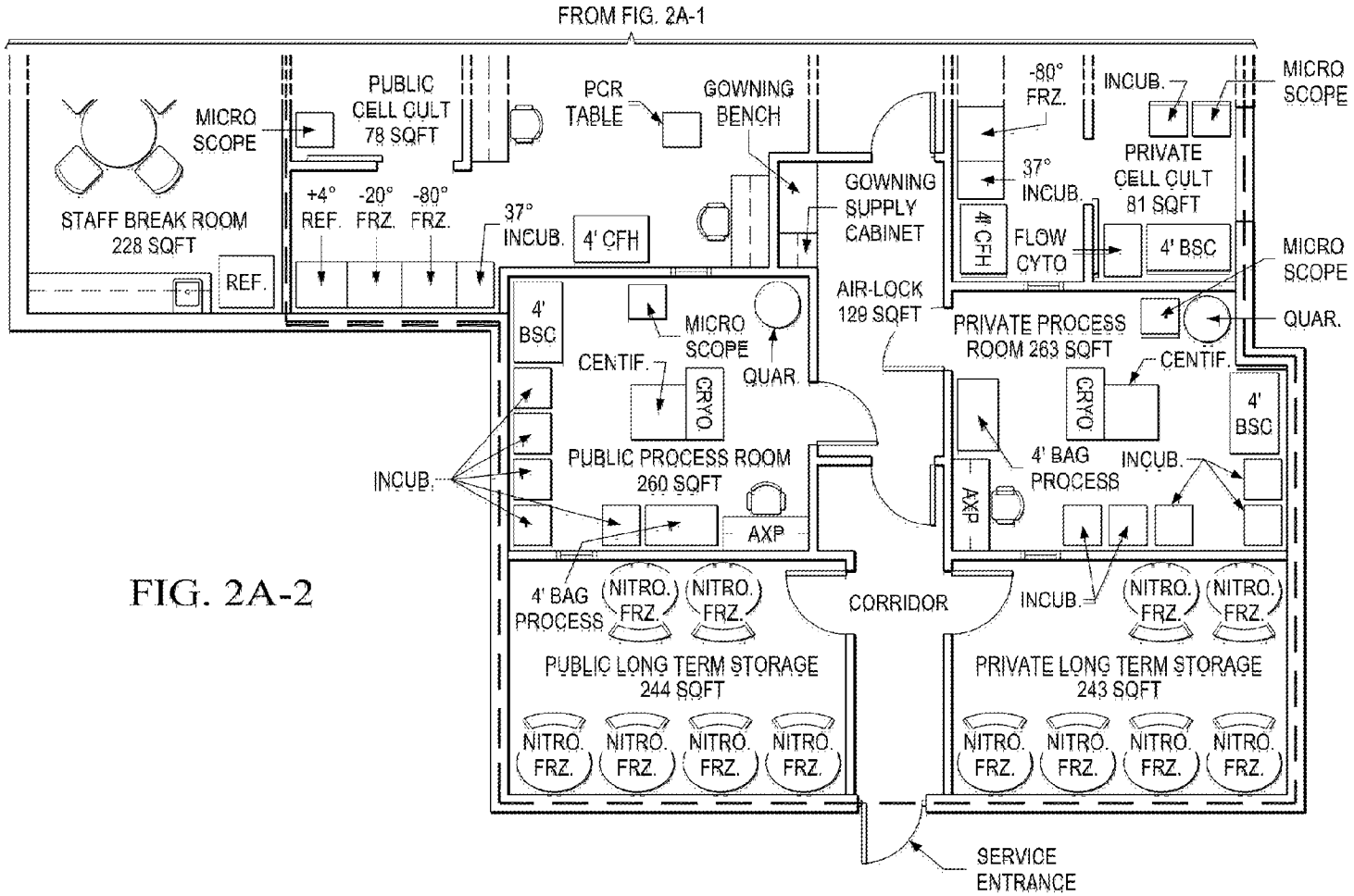
Figure 2B:
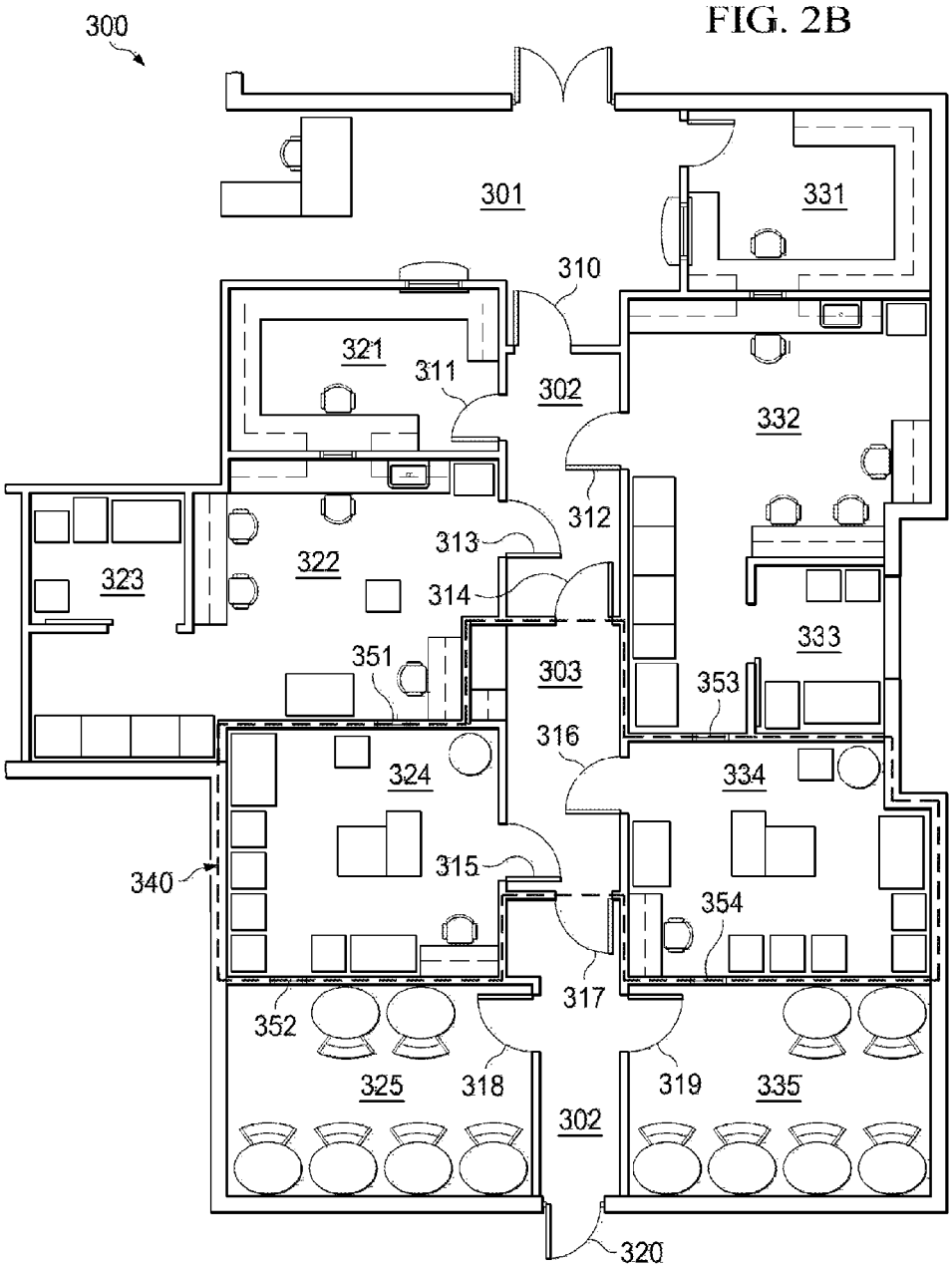
Figure 3:
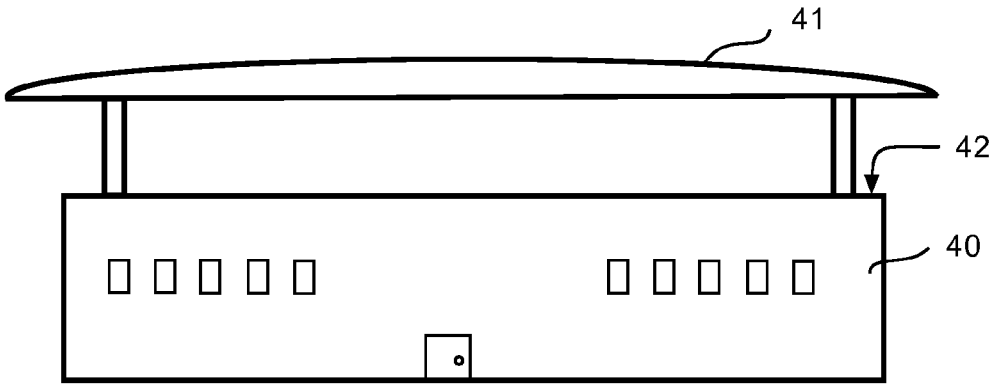
FIG. 3 is a schematic view showing the roof of the tissue bank being covered by a canopy.

FIGS. 2A (including 2A-1 and 2A-2) and 2B shows an alternative floor plan of the present invention, in which FIGS. 2A-1 and 2A-2 are the complete floor plan with every detail available, whereas FIG. 2B is a simplified version of FIG. 2A where only the necessary features circled by broken lines are present for the purpose of illustration. Referring both to FIGS. 2A and 2B, The facility floor plan starts with a waiting area 301 on one end, and then the tissue bank 300 is separated divided by a central corridor 302 with a secured door 310 separating the waiting area 301 and the rest of the tissue bank. The divided tissue bank has public receiving room 321, public diagnostic room 322, public cell culture room 323, public process room 324, and public long term storage 325 on one side, and private receiving room 331, private diagnostic room 332, private cell culture room 333, private process room 334, and private long term storage 335 on the other side. The central corridor 302 also includes an air-lock area 303 where both the public process room 324 and private process room 334 can be air-lock to exclude unnecessary contaminants. The air-lock area 303, the public process room 324 and private process room 334 together are the designated the clean room area 340.

As discussed above, airflow is into the clean room area 340, and out of the diagnostic and storage areas (and if present the receiving and shipping areas), and all equipment is continuously monitored. Samples travel from one area to the next with pass-through windows, which preferably comprise small chambers with two doors, and preferably only one door can be opened at once.

As shown in FIG. 2A, client reception, control rooms, nitrogen tank rooms, generator rooms, offices, and the like are also presented. However, these additional spaces are exterior to the basic plan described above so that the flow of sample is never interrupted. Such offices etc. are not part of work flow (defined with respect to tissue processing) and thus do not interrupt the basic floor plan, as shown in FIG. 2B.

The central corridor 302 is restricted to trained personnel, or when needed emergency/repair personnel escorted by trained personnel. The hallway commences by a secured door 310 at the level of the receiving area. From here, trained personnel can enter public receiving area 321 through the secured door 311. Trained personnel can continue down the corridor 302 and enter the diagnostics and research areas 322, 332 through more secured doors 313, 312 on either side of the hallway. The public and private diagnostic rooms 322, 332 also connect to public and private cell culture rooms 323, 333. Further down the hall is a secured door 314 access to an air locked gowning area 303 where trained personnel dress up in special garments and may wash hands and face before entering into processing and manufacturing rooms 324, 334 through secured doors 315, 316 on either side of the hallway.

If desired, the clean room area 340 can instead begin at the diagnostic space 322, 332 (e.g., one space earlier), and diagnostics entered via airlock but this may not be necessary as discussed above.

Each processing room 324, 334 is air quality and flow controlled by special filters and vents that blow highly filtered-very low particulate air into the processing rooms. This is the only air that enters the processing rooms as it creates a positive pressure in the room so that when the clean room processing door is opened, air flows out rather than in. Air also leaves the processing rooms by positive pressure through vents into adjacent diagnostic and storage areas. Also, samples come into and leave the processing rooms 324, 334 through pass-through windows 351, 352, 353 and 354.

From the air-lock gowning area 303, trained personnel can continue walking down the corridor to reach a secured door 317 that leads to the corridor separating the two opposite storage areas 325, 335. Storage areas 325, 335 on either side of the corridor are accessed through secured doors 318, 319 as well. Further down are other secured doors on either side of the hall leading to service entrance 320 that leads either outside the building or another hallway that returns to the receiving area from behind storage, processing, diagnostic areas.

Airflow is unidirectional, aspirated from outside through special ventilators, into filters, to processing rooms 324, 334, to diagnostic and storage rooms 322, 332, 325, 335 and back to hallways and receiving areas 321, 331 before leaving the building. Therefore, clean air that flows into the processing rooms never returns. The rest of the rooms are receiving processing room air output that is cleaner that normal unfiltered air and hence minimizing air borne contaminants and risk of losing the effectiveness and purity of the biological material.

Stored material that needs to be released will be removed from liquid nitrogen Dewars in the storage room and placed in a portable liquid nitrogen Dewar before shipping. Shipping can be initiated from a release room adjacent to the storage room or from the receiving area, as space permits.

What is claimed is:

1. A facility for a hybrid tissue bank, said facility comprising a central access-way having private space on one side and public space on the other side, said public and private spaces each being divided into a diagnostic room followed by a processing clean room followed by a storage room, wherein air flows into said processing clean room, and wherein said clean room processing space has sample pass through chambers comprising a chamber having two access panels, allowing samples to be passed-through to said diagnostic space and said storage space, and wherein said central access-way includes a clean room airlock leading to a clean room gowning area for sole human entry into said processing clean room.

2. The facility of claim 1, further comprising a sample receiving room preceding the diagnostic room.

3. The facility of claim 1, further comprising a sample shipping room following the storage room.

4. The facility of claim 1, further comprising a sample receiving room preceding the diagnostic room and a sample shipping room following the storage room.

5. The facility of claim 4, further comprising sample pass through chambers between said receiving room and said diagnostic room and said storage room and said shipping room.

6. The facility of claim 1, further comprising diagnostic, processing and storage equipment, wherein said equipment is continually monitored for correct functioning.

7. The facility of claim 1, further comprising a sample receiving room preceding the diagnostic room and a sample shipping room following the storage room, sample pass-through chambers between said receiving room and said diagnostic room and said storage room and said shipping room, and further comprising diagnostic, processing and storage equipment, wherein said equipment is monitored for correct functioning.

8. The facility of claim 7, wherein said processing clean room, clean room gowning area and clean room airlock are at least class 10,000 compliant.

9. The facility of claim 1, wherein said processing clean room, clean room gowning area and clean room airlock are at least class 10,000 compliant.

10. The facility of claim 1, wherein said clean room airlock is at least class 50,000 compliant.

11. The facility of claim 1, further comprising controlled access doors into each room and airlock and gowning area that are continuously monitored.

12. The facility of claim 1, further comprising a roof over all of said space and a protective canopy above said roof.

13. The facility of claim 1, further comprising a roof over all of said space and a protective canopy at least 5 foot above said roof.

14. The facility of claim 1, wherein said processing clean room is double walled.

15. The facility of claim 1, further comprising a sample receiving room preceding the diagnostic room and a sample shipping room following the storage room, sample pass-through chambers between said receiving room and said diagnostic room and said storage room and said shipping room, and further comprising diagnostic, processing and storage equipment, wherein said equipment function is monitored, and wherein said processing clean room and clean room gowning area are at least class 10,000 compliant and wherein said and clean room airlock is at least class 50,000 compliant.

16. A tissue bank, said bank comprising a building having a roof and enclosing at least:

a) a central corridor having private space on one side and public space on the other side, b) said public and private spaces each being divided into a sample receiving room followed by a diagnostic room followed by a processing clean room followed by a storage room, c) wherein pass-through chambers comprising an enclosed chamber having two access panels are positioned in a dividing wall between each of said rooms, d) wherein air flows into said processing clean room, and out of the remaining rooms or corridor, and e) wherein said central corridor includes an airlock leading to a gowning area for sole human entry into said processing clean room, f) wherein controlled access and monitored doors lead from the central corridor into said receiving, diagnostic, and storage rooms, and into said processing clean room via said gowning area and airlock, g) wherein said bank further comprises diagnostic, processing and storage equipment, wherein said equipment function is continuously monitored.

17. The bank of claim 16, wherein said processing clean room and clean room gowning area are at least class 10,000 compliant and wherein said and clean room airlock is at least class 50,000 compliant.

18. The bank of claim 17, further comprising a protective canopy at least 1 foot over said roof.

19. The bank of claim 17, further comprising a protective canopy at least 5 feet over said roof.

20. The bank of claim 17, wherein said processing clean room and clean room gowning area are at least class 10,000 compliant and wherein said and clean room airlock is at least class 50,000 compliant, and further comprising a protective canopy at least 1 foot over said roof.

21. The bank of claim 17, wherein said processing clean room and clean room gowning area are at least class 10,000 compliant and wherein said and clean room airlock is at least class 50,000 compliant.

22. The tissue bank of claim 16, wherein in said public and private spaces being divided the storage room is further followed by a product shipping room, and wherein the controlled access and monitored doors further lead from central corridor into said product shipping rooms.

23. A tissue bank, said bank comprising a building having a roof and enclosing at least:

a) a corridor having space on one side, b) said space being divided into a sample receiving room followed by a diagnostic room followed by a processing clean room followed by a storage room, c) wherein pass-through chambers comprising an enclosed chamber having two access panels are positioned in a dividing wall between each of said rooms, d) wherein air flows into said processing clean room, and out of the remaining rooms or corridor, and e) wherein said corridor includes an airlock leading to a gowning area for sole human entry into said processing clean room, f) wherein controlled access and monitored doors lead from the corridor into said shipping, diagnostic, and storage rooms, and into said processing clean room via said gowning area and airlock, g) wherein said bank further comprises diagnostic, processing and storage equipment, wherein said equipment function is continuously monitored.

24. The tissue bank of claim 23, wherein in said space being divided the storage room is further followed by a product shipping room, and wherein the controlled access and monitored doors further lead from central corridor into said product shipping rooms.

* * * * *